United States Patent [19]

Bussjager

[11] 4,240,269

[45] Dec. 23, 1980

[54] HEAT PUMP SYSTEM

[75] Inventor: Rudy C. Bussjager, Syracuse, N.Y.

[73] Assignee: Carrier Corporation, Syracuse, N.Y.

[21] Appl. No.: 43,285

[22] Filed: May 29, 1979

[51] Int. Cl.[3] ..... F25B 13/00

[52] U.S. Cl. ..... 62/324 A; 62/324 R

[58] Field of Search ..... 62/324 A, 324 R

[56] References Cited

U.S. PATENT DOCUMENTS

| | | | |
|---|---|---|---|
| 2,785,540 | 3/1957 | Biehn | 62/324 A |
| 3,132,492 | 5/1964 | McGrath | 62/324 R |
| 3,158,006 | 11/1964 | Skeats et al. | 62/324 A |
| 4,057,975 | 11/1977 | del Toro | 62/324 R |
| 4,057,976 | 11/1977 | del Toro | 62/324 R |
| 4,057,977 | 11/1977 | Chambless | 62/324 R |
| 4,171,622 | 10/1979 | Yamaguchi et al. | 62/324 R |

*Primary Examiner*—Lloyd L. King

*Attorney, Agent, or Firm*—J. Raymond Curtin; Robert P. Hayter

[57] ABSTRACT

A heat pump system includes a compressor, indoor and outdoor coils and a four-way valve for automatically reversing refrigerant to provide cooling or heating mode of operation. Each coil has a plurality of heat transfer circuits arranged in series when the coil operates as a condenser, and in a parallel when the coil operates as an evaporator. A second four-way reversing valve is provided in the refrigerant circuit between outlets of indoor and outdoor coils to direct refrigerant through liquid lines of the refrigerant circuit from the outlet of one coil used as a condenser to the expansion means of the other coil used as an evaporator. The second four-way reversing valve is arranged in the refrigerant circuit to connect some of heat transfer circuits connected in parallel in each coil when it is used as an evaporator, to the suction line of the compressor.

9 Claims, 1 Drawing Figure

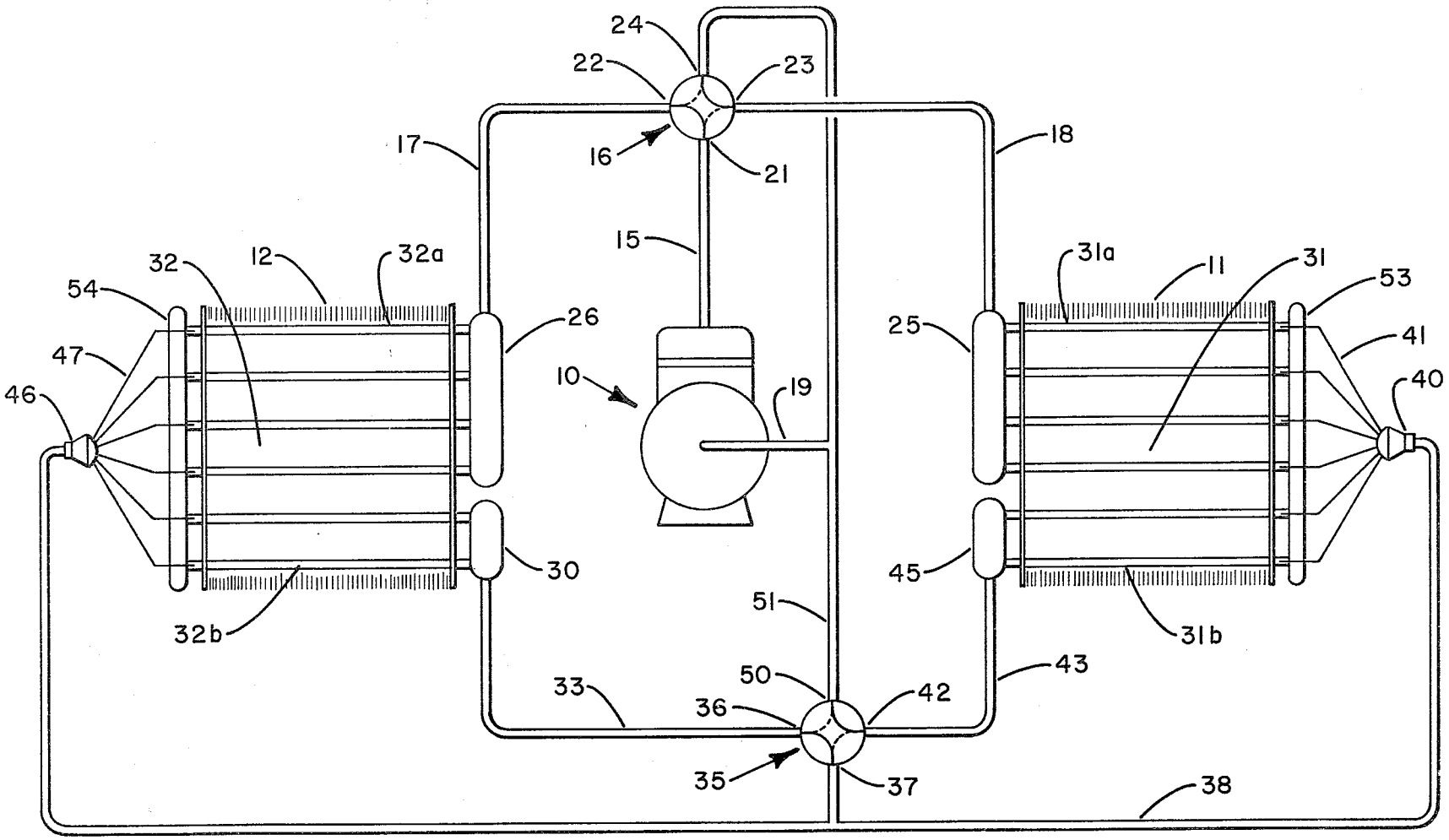
40
41
53
31
11
31a
31b
38
18
43
25
45
42
37
23
21
19
51
50
36
35
24
22
16
15
10
26
30
33
17
32a
12
32
32b
54
47
46

HEAT PUMP SYSTEM

BACKGROUND OF THE INVENTION

1. Field of the Invention

This invention relates to heat pumps and more particularly to control means for automatically reversing refrigerant flow to provide heating, cooling or defrosting.

2. Description of the Prior Art

It is well known in the art that heat pumps include indoor and outdoor coils or heat exchangers connected in a closed refrigerant circuit. Refrigerant is circulated through the coils by a compressor which draws the refrigerant from one coil, compresses the refrigerant and delivers the compressed refrigerant to the other coil where it is condensed and flows through expansion device such as a capillary tube or expansion valve, to the first coil for evaporation. The system typically includes a changeover valve for periodically reversing the refrigerant flow so that the unit operates on a cooling cycle or a heating cycle. Typically, a four-way valve is employed in foregoing system to reverse the cycles. To increase the efficiency of the heat pump system where the same heat transfer coil is selectively used as a condenser or an evaporator, the coils are provided with a plurality of heat transfer circuits. These circuits are arranged to be in a series when the coil operates as a condenser and in parallel when the coil operates as an evaporator. To enable this system to operate under the reverse cycle principle a number of check valves are utilized to direct the refrigerant flow through the coils in series when the coil is functioning as a condenser and to direct flow through the circuits in parallel when the coil is functioning as an evaporator. A number of check valves are also arranged in the circuit to permit refrigerant flow from each heat transfer circuit connected in the coil in parallel when the coil is operating as an evaporator, to a suction line of the compressor. Utilization of large numbers of valves requires a number of mechanical joints which must operate under conditions of relatively high pressures and temperatures. It is therefore desirable to eliminate these check valves to the extent possible.

SUMMARY OF THE INVENTION

It is an object of the present invention to provide an improved heat pump system.

Another object of the present invention is to provide an improved means for directing refrigerant flow through a heat pump system.

It is a further object of the invention to eliminate or reduce the number of check valves used in a heat pump air conditioning system.

Still another object of the present invention is to provide means for automatically regulating the effective charge of refrigerant in the system in either a cooling or a heating mode of operation.

These and other objects of the present invention are attained by utilizing two four-way reversing valves in a refrigerant circuit between the inlets and outlets of the indoor and outdoor coils of the heat pump system. The first four-way valve is used to direct refrigerant periodically to flow in a series through each coil when that coil is operating as a condenser and to receive refrigerant flowing in parallel circuit when a coil is operating as an evaporator. The second reversing four-way valve is mounted in the refrigerant circuit either to connect selectively the outlet of one coil used as a condenser to the expansion means associated with the other or evaporator coil or to connect some circuits arranged in a parallel in the coil used as an evaporator to a suction line of the compressor.

BRIEF DESCRIPTION OF THE DRAWINGS

The FIGURE shows a diagrammatic view of a heat pump embodying the invention described hereto.

DESCRIPTION OF THE PREFERRED EMBODIMENT

The FIGURE illustrates the form of the invention utilized in a reversible vapor compression system. The system includes a compressor 10 and two refrigerant heat exchangers 11 and 12. Heat exchanger 11 represents an indoor coil, and heat exchanger 12 represents an outdoor coil.

Compressor 10 has a high pressure gas discharge connected by discharge line 15 to a port 21 of a reversing four-way valve 16. Conventional four-way valves include a movable element, within a sealed casing which can be positioned to change the flow path between flow lines connected to the valve. By positioning selectively the four-way valve, the connection to the discharge side and suction side of the compressor can be reversed between the heat exchangers. The four-way valve 16 shown herein includes ports or conduit connections 21, 22, 23 and 24. Port 22 is connected to a conduit 17 which is joined to a header 26 of outdoor coil 12. Conduit 17 is an inlet line when outdoor coil 12 is used as a condenser in a cooling mode of operation. Port 23 of valve 16 is connected by a conduit 18 to a header 25 of indoor coil 11. Conduit 18 is the inlet line when indoor coil 11 is used as a condenser in a heating mode of operation. The suction line of compressor 10 is connected by a conduit 19 to port 24 of valve 16.

When the coil 12 is operating as a condenser, that is the system is in a cooling cycle, valve 16 is in position shown by the solid lines. Is this compressed refrigerant is passed from compressor 10 through line 15 to valve 16 and then through conduit 17 into outdoor coil 12 where the refrigerant condenses. The liquid refrigerant then flows to the indoor coil 11. The coil 11 during the cooling mode of operation functions as an evaporator. The solid lines between ports 23 and 24 on the valve 16 show the flow of refrigerant when the coil 11 is functioning as an evaporator. The gaseous refrigerant passes from coil 11 through conduit 18 to port 23 of valve 16 and then is directed by port 24 into suction line 19 of the compressor.

When the coil 11 functions as condenser, that is the system is in the heating mode of operation, the valve 16 is moved to the position shown in dotted lines. During the heating cycle the compressed refrigerant flows from discharge line 15 to port 21 of valve 16 where it is routed to conduit 18 and then into indoor coil 11. After passing coils 11 and 12, the refrigerant from the coil 12 passes through line 17 to port 22 of valve 16 where it is directed by port 24 as shown by dotted lines, to line 19 and then to the suction of compressor 10.

Each of heat exchangers 11 and 12 involves a plurality of tube circuits shown generally as 31 and 32 respectively. It should be noted that in heat pump arrangements of the foregoing type the pressure of the refrigerant passing through a heat exchanger operating as a condenser where the high pressure gas condenses to a liquid, is higher than that required of the heat exchanger operating as an evaporator where liquid refrigerant is changed to a gas. As the refrigerant gas condenses to a high pressure liquid it needs less volume for a given mass than when the coil is functioning as an evaporator. In the evaporator the pressure is low and the liquid refrigerant is changed to a vaporous gas which needs a greater volume for a given mass than the liquid refrigerant. Therefore, in order to use each coil in both operating cycles effectively, the flow of refrigerant is directed through the circuits so that it flows in series through the various coils of the heat exchanger when the heat exchanger operates as a condenser. A series refrigerant flow is provided through tube circuits 32*a* and 32*b* in the outdoor coil 12 when it is functioning as a condenser and through tube circuits 31*a* and 31*b* in the indoor coil 11 when it operates as a condenser. The circuits 32*a* and 32*b* are connected in series by a header 54 and the circuits 31*a* and 31*b* are connected in series by a header 53. This series refrigerant flow arrangement of the coil 11 or 12 provides a relatively long length of coil to allow a pressure drop in the coil that is sufficient to condense the high pressure gas into a liquid. When the heat exchanger operates as an evaporator the refrigerant is directed from the expansion means through the tube circuits simultaneously to establish parallel flow passages in the heat exchanger. The tube circuits 31*a* and 31*b* in the coil 11 are arranged in parallel between a header 53 and headers 25 and 45, and the tube circuits 32*a* and 32*b* are arranged in parallel between header 54 and headers 26 and 30. This arrangement provides a relatively shorter length of each tube circuit and a greater number of circuits. The operation of the tube circuits arranged in series and in parallel is explained in a greater detail below.

The heat pump system shown in the FIGURE includes a second four-way valve 35 connected to header 30 of outdoor coil 12 by a conduit 33 and to header 45 of indoor coil 11 by a conduit 43. The second four-way valve contains ports or conduit connections 36, 37, 42, and 50. Valve 35 is positioned in the refrigerant circuit to direct, selectively, refrigerant flow leaving either coil 11 or 12 through a conduit 51 into the suction line 19 of compressor 10 or through a line or conduit 38 leading to either coil 11 or 12. The conduit 38 interconnecting outdoor coil 12 with indoor coil 11 is connected to a distributor 40 leading to the coil 11 and to a distributor 46 leading to the coil 12. Capillary tubes 41 are positioned between distributor 40 and header 53 of the indoor coil 11. Capillary tubes 47 are located between distributor 46 and header 54 of outdoor coil 12.

In a cooling mode of operation the high pressure discharge gas is routed through ports 21 and 22 of four-way valve 16 to conduit 17 and then to header 26 of the outdoor coil 12 which operates as a condenser during the cooling cycle. From header 26 the refrigerant flows through four tubes forming the tube circuit 32*a* and is passed into header 54. Then the refrigerant flows downwardly through header 54 and enters the two tubes forming the second tube circuit 32*b* arranged in series with the upper tube circuit 32*a*. The refrigerant passing the tube circuits 32*a* and 32*b* is condensed to a liquid which flows to header 30 and then conduit 33. From conduit 33 the liquid refrigerant flows through port 36 of valve 35 which directs the flow to the port 37 (shown by the solid line) and then into conduit 38 interconnecting outdoor coil 12 with indoor coil 11. High pressure liquid refrigerant flows through the conduit 38 to distributor 40 and then to capillary tubes 41 where the pressure is dropped and the refrigerant is expanded. Some amount of liquid refrigerant will spill out through conduit 38 into a second distributor 46 and then through capillary tubes 47 into header 54. However, the mixture of liquid and gas refrigerant in coil 12 is at pressure higher than that in a liquid conduit 38 and will not permit refrigerant from conduit 38 into the circuits of the outdoor coil 12. In some instances a check valve is arranged before distributor 46 to make it inoperative when coil 12 functions as a condenser. Capillary tubes 41 are connected to each length of tubing of the circuits 31*a* and 31*b* of the indoor coil 11 which now are arranged in parallel. The low pressure liquid refrigerant passes from capillary tubes 41 into header 53 and then through the tubes of circuit 31*a* and through the tubes of circuit 31*b* simultaneously where the liquid refrigerant is changed to a gas phase. Circuit 31*b* is completed through two tubes into a header 45. Then the vaporous refrigerant is directed from conduit 43 through ports 42 and 50 of valve 35 which connects conduit 43 to a conduit 51 associated with suction line 19 of compressor 10. At this time a movable or rotatable element in the valve 35 is positioned to prevent the flow of low pressure refrigerant from conduit 43 into line 38 and to prevent high pressure liquid from conduit 33 into conduit 43. The second tube circuit 31*a* is completed through four parallel tubes from which the vaporized refrigerant flows to header 25 and then into conduit 18 which is connected to port 23 of valve 16. Ports 23, 24 direct the flow of the vaporized refrigerant to suction line 19 of compressor 10.

In a heating mode of operation the movable element of the valve 16 is rotated to connect ports 21 and 23 and break the connection between ports 21 and 22. The high pressure discharge gas from discharge line 15 of compressor 10 is routed by ports 21 and 23 through conduit 18 into header 25 of indoor coil 11 which is used now as a condenser. High pressure gas refrigerant passes the four tubes of tube circuit 31*a* of the indoor coil 11 and enters the header 53 from which the refrigerant flows into two tubes of second circuit 31*b*. Passing through the tube circuits 31*a* and 31*b* in series the refrigerant is condensed to a high pressure liquid which flows to the lower header 45 and then enters conduit 43. The rotatable element of four-way valve 35 at this time connects ports 42 and 37 as shown by dotted lines. From conduit 43 the liquid refrigerant is directed by ports 42, 37 into the line 38. The liquid refrigerant flows through a second distributor 46 to capillary tubes 47. At this time a rotatable element of valve 35 is positioned to prevent high pressure liquid from entering conduits 33 or 50. Circuits 32*a* and 32*b* in this cycle are arranged in parallel. The high pressure liquid is expanded in capillary tubes 47 and the resultant low pressure liquid enters the header 54 and then four tubes of tube circuit 32 a and two tubes of tube circuit 32*b* simultaneously. Circuit 32*b* is completed into header 30 from which vapor refrigerant flows into conduit 33 and then is directed by ports 36 and 50 of valve 35 to conduit 51 connected to suction line 19 of the compressor. The position of rotatable element in valve 35 precludes refrigerant from conduit 33 into conduit 38 at this time. The second parallel circuit 32*a* in the outdoor coil 12 is completed through four tubes into upper header 26 from which the refrigerant in a gas state flows into conduit 17 and then by ports 22 and 24 is directed to suction line 19 of compressor 10. The application of second reversing valve 35 in the refrigerant circuit between coils 11 and 12 substitutes the use of four check valves in the system of the foregoing type.

It should be noted that the heat pump system described above is not necessarily limited by the use of headers connected to the heat exchangers when the invention is carried out in connection with a simple heat exchanger. The header in the coil can be replaced with tubing capable of directing and receiving the refrigerant into and out of the coil.

During heating operation when low outdoor temperatures are attained, the outdoor exchange coil 12 often becomes coated with an insulating layer of frost which blocks the efficiency of the refrigerating system by reducing the heat transfer characteristics of this coil. Means are commonly provided for periodically reversing the refrigerant flow so that the unit reverts to cooling cycle operation.

Normally, when defrost is required, the valve 16 is actuated, permitting hot gaseous refrigerant from compressor 10 to flow through the discharge line 15, outdoor coil 12, then the indoor coil 11 and then back through conduit 18 and valve 16 to the compressor. The hot gaseous refrigerant flows through the outdoor coil for a brief time. The outdoor coil temporarily acts as a condenser and the indoor coil as an evaporator to remove the coating of frost from the outdoor coil. The system employed in the present invention provides a non-reserve defrost. In a non-reverse defrosting operation the indoor coil 11 is arranged out of operation with the aid of the valve 35. The movable elements of valves 16 and 35 are positioned to permit the refrigerant to flow through the outdoor coil for a brief time and then back into compressor 10 through conduits 33, 51 and 19 and preclude refrigerant from flowing into conduit 38.

While this invention has been illustrated in accordance with a preferred embodiment, it is recognized that variation and changes may be made therein without departing from the invention as set forth in the claims.

I claim:

1. A heat pump system including a refrigeration circuit comprising:

a compressor having a discharge line and a suction line, a first heat exchanger, a second heat exchanger, each heat exchanger including a plurality of heat transfer circuits arranged to provide series flow of refrigerant through the circuits when the heat exchanger is used as a condenser and parallel refrigerant flow through the circuits when the heat exchanger is used as an evaporator, expansion means connected to each of the heat exchangers for expanding refrigerant flowing into the heat exchanger when the heat exchanger serves as an evaporator, first reversing means connected to the compressor, the first heat exchanger and the second heat exchanger for directing refrigerant to flow in series through the circuits of the heat exchanger serving as a condenser and for receiving refrigerant from the heat exchanger serving as an evaporator, refrigerant conduit means connecting the compressor and said heat exchangers to provide a closed refrigerant circuit, said refrigerant conduit means having a passageway interconnecting the expansion means of said heat exchangers, second reversing means operatively associated with the first reversing means and disposed in the refrigerant circuit between the first and second heat exchangers for permitting refrigerant to flow from the heat exchanger operating as a condenser through said passageway into the expansion means of the other heat exchanger operating as an evaporator and for receiving refrigerant from the heat exchanger serving as the evaporator, at least one of said reversing means being connected to the suction line of the compressor such that refrigerant received from the heat exchanger serving as the evaporator is directed to the compressor to form a complete refrigerant circuit.

2. The heat pump in accordance with claim 1, wherein the refrigerant conduit means includes a conduit for connecting the first reversing means and the second reversing means to the suction line of the compressor.

3. The heat pump in accordance with claim 1 or 2, wherein said second reversing means is a four-way valve.

4. A heat pump system including a refrigeration circuit comprising:

a compressor having a discharge line and a suction line, a first heat exchanger, a second heat exchanger, expansion means connected to each of the heat exchangers for expanding refrigerant flowing into the heat exchanger when the heat exchanger serves as an evaporator, first reversing means connected to the compressor, the first heat exchanger and the second heat exchanger for directing refrigerant to the heat exchanger serving as a condenser and for receiving refrigerant from the heat exchanger serving as an evaporator, refrigerant conduit means connecting the compressor and said heat exchangers to provide a closed refrigerant circuit, second reversing means operatively associated with the first reversing means and disposed in the refrigerant conduit means between the first and second heat exchangers for permitting refrigerant to flow from the heat exchanger serving as a condenser to the expansion means of the heat exchanger serving as an evaporator and for receiving refrigerant flowing from the heat exchanger serving as an evaporator.

5. The heat pump system in accordance with claim 4 wherein the refrigerant conduit means further includes a passageway interconnecting the expansion means of said heat exchangers and wherein the second reversing means is disposed in said passageway.

6. The heat pump system in accordance with claim 4 wherein the refrigerant conduit means further comprises:

suction line conduit connecting both the first reversing means and the second reversing means to the compressor suction line such that refrigerant received by the first reversing means from the heat exchanger serving as an evaporator may be directed to the compressor and refrigerant received by the second reversing means from the heat exchanger serving as an evaporator may be directed to the compressor suction line.

7. The heat pump in accordance with claim 4 wherein the heat exchanger serving as an evaporator has all the circuits therein in parallel, some of said circuits being connected to discharge refrigerant to the first reversing means and some of said circuits being connected to discharge refrigerant to the second reversing means.

8. The heat pump in accordance with claim 4 wherein each heat exchanger includes a plurality of circuits arranged such that when the heat exchanger serves as an evaporator the refrigerant flows through the circuits in parallel and when the heat exchanger serves as a condenser the circuits have series refrigerant flow therethrough.

9. The heat pump in accordance with claim 7 wherein the heat exchangers each include a header connected to the circuits of the heat exchanger, said header serving when the heat exchanger is serving as a condenser to direct refrigerant from some of the circuits of the heat exchanger to other circuits of the heat exchanger and said header serving to allow the expansion means to direct refrigerant to all the circuits of the heat exchanger therethrough.

* * * * *